US005865156A

United States Patent [19]

Feucht et al.

[11] Patent Number: 5,865,156

[45] Date of Patent: Feb. 2, 1999

[54] ACTUATOR WHICH USES FLUCTUATING PRESSURE FROM AN OIL PUMP THAT POWERS A HYDRAULICALLY ACTUATED FUEL INJECTOR

[75] Inventors: Dennis D. Feucht, Morton; Andrew H. Nippert, Peoria, both of Ill.; Douglas J. Kinnear, Palmyra, N.Y.; Mylvagaganam Arulraja, Peoria, Ill.

[73] Assignee: Caterpillar Inc., Peoria, Ill.

[21] Appl. No.: 984,195

[22] Filed: Dec. 3, 1997

[51] Int. Cl.[6] ..... F02M 37/04

[52] U.S. Cl. ..... 123/446; 123/501

[58] Field of Search ..... 123/446, 447, 123/500, 501, 385, 386, 387

[56] References Cited

U.S. PATENT DOCUMENTS

| | | | |
|---|---|---|---|
| 4,020,809 | 5/1977 | Kern et al. | 123/119 |
| 4,290,404 | 9/1981 | Hata et al. | 123/571 |
| 4,333,438 | 6/1982 | Perez et al. | 123/569 |
| 4,531,706 | 7/1985 | Weiger et al. | 251/25 |
| 4,548,184 | 10/1985 | Laufer et al. | 123/569 |
| 4,718,385 | 1/1988 | Konrath | 123/449 |
| 4,907,560 | 3/1990 | Krieger | 123/569 |
| 5,467,756 | 11/1995 | Fischer et al. | 123/569 |
| 5,531,205 | 7/1996 | Cook et al. | 123/568 |
| 5,546,914 | 8/1996 | Scheinert | 123/569 |
| 5,651,245 | 7/1997 | Miller | 123/446 |
| 5,673,669 | 10/1997 | Maley | 123/446 |
| 5,685,272 | 11/1997 | Paul | 123/446 |
| 5,722,373 | 3/1998 | Paul | 123/446 |
| 5,732,678 | 3/1998 | Lindquist | 123/446 |
| 5,738,075 | 4/1998 | Chen | 123/446 |
| 5,740,782 | 4/1998 | Lowi | 123/446 |
| 5,785,021 | 7/1998 | Yudanou | 123/446 |

*Primary Examiner*—Carl S. Miller
*Attorney, Agent, or Firm*—Paul J. Maginot

[57] ABSTRACT

An actuator assembly that uses a fluctuating operational pressure generated by an injector oil pump to actuate an EGR valve is disclosed. The operational pressure is used to operate the actuator assembly without being adversely affected by the fluctuating nature of the operational pressure. The actuator assembly includes an actuator housing defining a chamber and an actuator oil inlet. The actuator oil inlet is in fluid communication with the pump outlet. The actuator assembly further includes a slider located within the chamber. The slider is positionable between a first slider position and a second slider position. The slider isolates the actuator oil inlet from the chamber when the slider is located in the first slider position. The actuator oil inlet is in fluid communication with the chamber when the slider is located in the second slider position. The actuator assembly still further includes a movement assembly for moving the slider between a first slider position and a second slider position. The fluctuating operational pressure moves the actuator piston from the first piston position to the second piston position when the slider is located in the second slider position. A method of actuating a valve in an engine assembly is also disclosed.

14 Claims, 6 Drawing Sheets

ACTUATOR WHICH USES FLUCTUATING PRESSURE FROM AN OIL PUMP THAT POWERS A HYDRAULICALLY ACTUATED FUEL INJECTOR

CROSS REFERENCE

Cross Reference is made to co-pending U.S. patent application Ser. No. 08/984,431, Caterpillar file 96-228, entitled "Exhaust Gas Recirculation Valve Powered By Pressure From An Oil Pump That Powers A Hydraulically Actuated Fuel Injector" by Feucht et al. which is assigned to the same assignee as the present invention, and filed concurrently herewith.

TECHNICAL FIELD OF THE INVENTION

The present invention relates generally to an exhaust gas recirculation (EGR) valve assembly, and more specifically to an actuator which uses fluctuating pressure from an oil pump that powers a hydraulically actuated fuel injector.

BACKGROUND OF THE INVENTION

During operation of an internal combustion engine, it is desirable to control the formation and emission of certain gases, such as the oxides of nitrogen ($NO_x$). One method of achieving this result is the use of EGR which is a process whereby exhaust gases are selectively routed from the exhaust manifold or manifolds to the intake manifold of the internal combustion engine. The use of EGR reduces the amount of $NO_x$ produced during operation of the internal combustion engine. In particular, $NO_x$ is produced when nitrogen and oxygen are combined at high temperatures associated with combustion. The presence of chemically inert gases, such as those gases found in the exhaust of the engine, inhibits nitrogen atoms from bonding with oxygen atoms thereby reducing $NO_x$ production.

An EGR system requires a valve assembly that selectively advances exhaust gases from the exhaust manifold to the intake manifold. Typical automotive EGR valves are actuated using the engine's vacuum system. A drawback to using these types of EGR valves in heavy machinery, such as construction equipment, is that many types of heavy machinery do not have suitable vacuum systems similar to those found in automobiles.

Another drawback in EGR valves found in automobiles is that these types of EGR valves produce a limited force. Engines used in heavy machinery can be several times larger than engines used in automobiles. Hence, the force required to open an EGR valve in an internal combustion engine used in heavy machinery is much greater than the force required to open an EGR valve in an automobile.

However, some types of heavy machinery have fuel injectors which utilize a hydraulic fluid to inject fuel into the combustion chamber. In particular, engine oil is pumped to a high pressure, typically 600 to 3000 psi by an injector oil pump. The pressurized oil drives a piston that forces fuel from the fuel injector to the combustion chamber. The high pressure volume generated by the injector oil pump exceeds the volume required to operate the fuel injector during certain engine operating conditions thereby leaving adequate surplus oil volume to actuate an EGR valve.

A drawback with using pressure that has been supplied by the injector oil pump is that this pressure varies considerably. In particular, the engine control module is configured so that changing engine operating conditions cause the injector oil pump to generate varying output oil pressure to meet the needs of the fuel injector. Thus, the pressure output from the injector oil pump is non-uniform.

What is needed therefore is an apparatus and method for selectively routing EGR gases which overcome one or more of the above-mentioned drawbacks.

DISCLOSURE OF THE INVENTION

In accordance with a first embodiment of the present invention, there is provided an engine assembly. The engine assembly includes an injector oil pump. The injector oil pump has a pump outlet. The injector oil pump generates an operational pressure at the pump outlet. The engine assembly further includes a fuel injector having an injector oil inlet, and an injector piston. The injector oil inlet is in fluid communication with the pump outlet of the injector oil pump. The operational pressure at the injector oil inlet acts on the injector piston so as to move the injector piston from a low pressure position in which fuel is prevented from being advanced out of the fuel injector to a high pressure position in which fuel is advanced out of the fuel injector. The engine assembly further includes an actuator assembly. The actuator assembly includes an actuator housing defining a chamber and an actuator oil inlet. The actuator oil inlet is in fluid communication with the pump outlet. The actuator assembly further includes a slider located within the chamber. The slider is positionable between a first slider position and a second slider position. The slider isolates the actuator oil inlet from the chamber when the slider is located in the first slider position. The actuator oil inlet is in fluid communication with the chamber when the slider is located in the second slider position. The actuator assembly still further includes a movement assembly for moving the slider between a first slider position and a second slider position. The actuator assembly yet further includes an actuator piston located within the chamber. The actuator piston is movable between a first piston position and a second piston position. The operational pressure moves the actuator piston from the first piston position to the second piston position when the slider is located in the second slider position.

In accordance with a second embodiment of the present invention, there is provided a method of actuating a valve in an engine assembly. The engine assembly an injector oil pump having a pump outlet, the injector oil pump generating operational pressure at the pump outlet, and a fuel injector having an injector oil inlet, and an injector piston. The injector oil inlet is in fluid communication with the pump outlet of the injector oil pump. The operational pressure at the injector oil inlet acts on the piston so as to move the injector piston from a low pressure position in which fuel is prevented from being advanced out of the fuel injector to a high pressure position in which fuel is advanced out of the fuel injector. The engine assembly further includes an actuator assembly. The actuator assembly has an actuator housing defining a chamber, an actuator oil inlet being in fluid communication with the pump outlet, and a slider located within the chamber. The slider being positionable between a first slider position and a second slider position. The actuator assembly further includes an actuator piston located within the chamber. The actuator piston being movable between a first piston position and a second piston position. The actuator assembly still further includes a movement assembly for moving a slider between a first slider position and a second slider position. The method includes the step of isolating the actuator oil inlet from the chamber when the slider is located in the first slider position. The method further includes the step of placing the actuator oil inlet is in fluid communication with the chamber when the slider is located in the second slider position and moving the actuator piston with operational pressure from the first piston position to the second piston position when the slider is located in the second slider position.

BEST MODE FOR CARRYING OUT THE INVENTION

Figure 1:
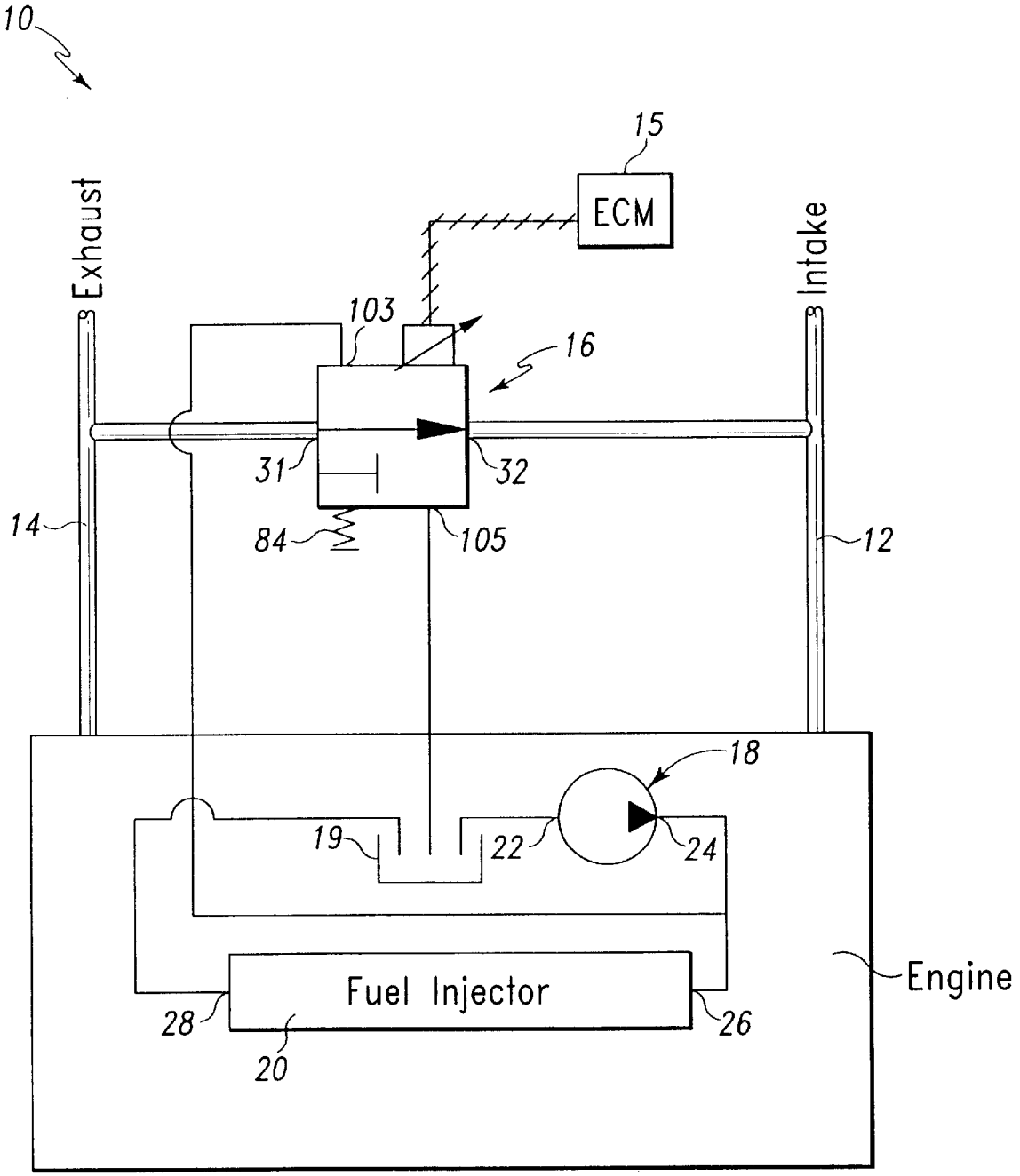
FIG. 1 is a schematic view of the internal combustion engine 10 which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a schematic diagram of an internal combustion engine 10 which is a six-cylinder turbocharged diesel engine. The internal combustion engine 10 includes an engine air inlet or intake manifold 12, an engine exhaust outlet or exhaust manifold 14, an engine control module 15, an EGR valve assembly 16, an injector oil pump 18, an engine oil sump 19, and a fuel injector 20.

The internal combustion engine 10 is a four stroke engine. The first stroke is an intake stroke wherein air is advanced from the intake manifold 12 to a combustion chamber (not shown). The engine then advances to a compression stroke, where the air is compressed in the combustion chamber. Near the end of the compression stroke, the fuel injector 20 injects a fuel, such as diesel fuel, into the combustion chamber thereby creating a fuel and air mixture in the combustion chamber. Near the top of the compression stroke, the fuel and air mixture is ignited by the heat generated as a result of the compression stroke. Ignition of the fuel and air mixture advances the internal combustion engine 10 to a power stroke in which the fuel and air mixture is combusted and exhaust gases are formed. The combustion of the fuel and air mixture produces energy which is converted to mechanical work by a known mechanical linkage (not shown) that consists of a piston, connecting rod, and crankshaft. Thereafter, the internal combustion engine 10 is advanced to an exhaust stroke wherein exhaust gases are advanced from the combustion chamber to the exhaust manifold 14.

During certain operating conditions of the internal combustion engine 10, it is desirable to inhibit the formation of $NO_x$ by introducing chemically inert exhaust gases into the combustion chamber during the intake stroke. Hence, the EGR valve assembly 16 routes exhaust gases from the exhaust manifolds 14 to the intake manifold 12. In particular, the EGR valve assembly 16 selectively places the exhaust manifold 14 in fluid communication with the intake manifold 12 during such operating conditions.

A hydraulic oil circuit provides high pressure oil to the fuel injector 20 and the EGR valve assembly 16. In particular, the injector oil pump 18 has a pump inlet 22 and a pump outlet 24. The pump inlet 22 is coupled the oil sump 19. The injector oil pump 18 draws oil from the sump 19, through the pump inlet 22, and pressurizes the oil to an operational pressure (typically 600 to 3000 psi) before advancing the oil to the pump outlet 24. The pump outlet 24 supplies oil at the operational pressure to the fuel injector 20 and the EGR valve assembly 16.

The fuel injector 20 includes an injector oil inlet 26 and an injector oil outlet 28. The pump outlet 24 of the injector oil pump 18 is coupled to the injector oil inlet 26 of the fuel injector 20. The fuel injector 20 uses oil at the operational pressure from the injector oil pump 18 to pressurize fuel in the injector 20. Thereafter, the pressurized fuel is injected into the combustion chamber. The oil exits the fuel injector at the injector oil outlet 28 and is vented to the sump 19.

The EGR valve assembly 16 includes a valve oil inlet or actuator oil inlet 103 and a valve oil outlet or actuator oil outlet 105. The pump outlet 24 of the injector oil pump 18 is also coupled to the actuator oil inlet 103 of the EGR valve assembly 16. The EGR valve assembly 16 uses operational pressure generated by the injector oil pump 18 to actuate the EGR valve assembly 16. After actuating the EGR valve assembly 16, hydraulic oil exits the EGR valve assembly 16 at the actuator oil outlet 105. The actuator oil outlet 105 is coupled to the oil sump 19. In particular, oil that is advanced from the actuator oil outlet 105 is returned to the oil sump 19, where the oil is subsequently pressurized by the oil pump 18 as described above.

Figure 2:
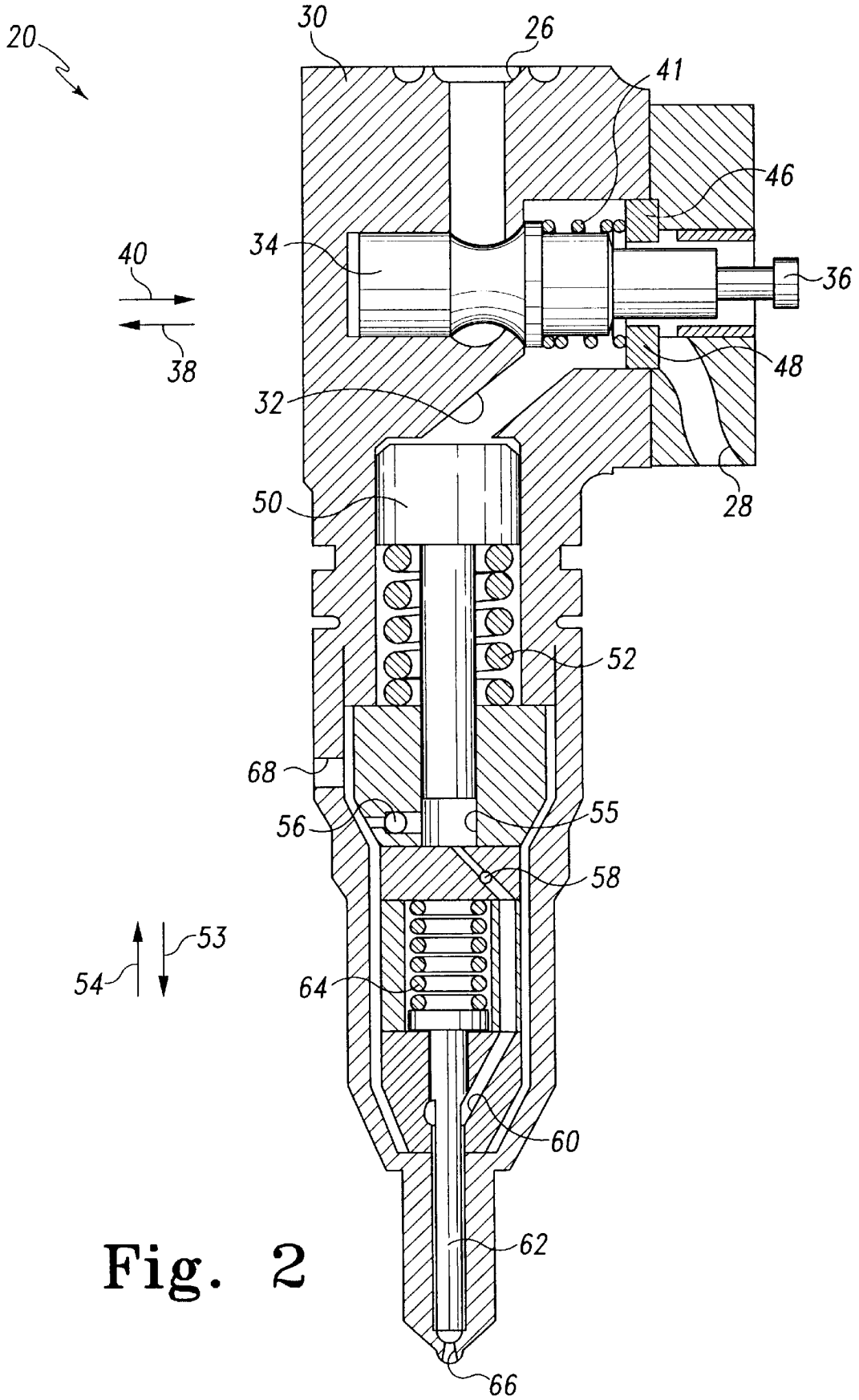
FIG. 2 is an enlarged cross sectional view of the fuel injector of the of the internal combustion engine 10 of FIG. 1, showing fuel injector at the beginning of an injection cycle.
Figure 3:
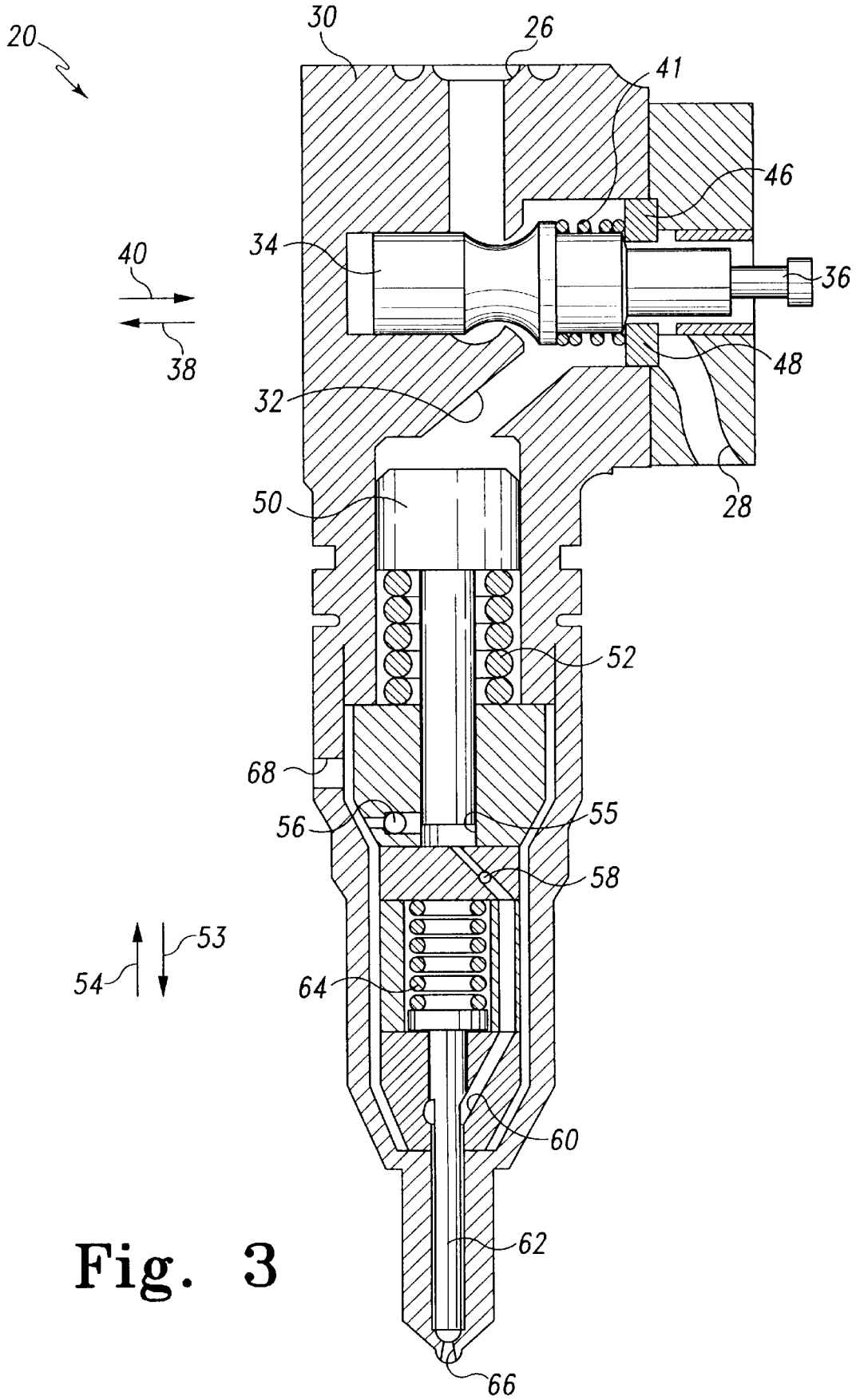
FIG. 3 is a view similar to FIG. 2 but showing the fuel injector at the end of an injection cycle.

Referring now to FIGS. 2 and 3, there is shown the fuel injector 20 of the internal combustion engine 10. The fuel injector 20 includes an injector housing 30 which defines an injector oil chamber 32. The injector oil chamber 32 is in fluid communication with both the injector oil inlet 26 and the injector oil outlet 28.

The fuel injector 20 further includes an injector valve 34 which selectively places either the injector oil inlet 26 in fluid communication with the injector oil chamber 32 as shown in FIG. 3 or places the injector oil outlet 28 in fluid communication with the injector oil chamber 32 as shown in FIG. 2. In particular, an injector solenoid 36 moves the injector valve 34 in the general direction of arrows 38 and 40. A solenoid spring 41 is interposed between the injector valve 34 and the injector housing 30.

On an injection cycle, the engine control module 15 applies a current to solenoid 36, causing the solenoid 36 to apply a force to the injector valve 34 in the general direction of arrow 40. As the force of the injector solenoid 36 overcomes the bias force of the solenoid spring 41, the injector solenoid 36 urges injector valve 34 in the general direction of arrow 40 so as to place the injector oil inlet 26 in fluid communication with the injector oil chamber 32. Furthermore, as the injector valve 34 is urged in the general direction of arrow 40, the valve seats against surfaces 46 and 48 in order to isolate the injector oil outlet 28 from the injector oil chamber 32. Placing the injector oil inlet 26 in fluid communication with in injector oil chamber 32 and isolating the injector oil outlet 28 from the injector oil chamber 32, fills the injector oil chamber 32 with oil at the operational pressure.

An injector piston 50 is located in the lower portion of the injector oil chamber 32. As oil at the operational pressure fills the injector oil chamber 32, the injector piston 50 is urged in the general direction of arrow 53. An injector spring 52 is interposed between the injector housing 30 and the injector piston 50. The injector spring 52 urges the injector piston 50 in the general direction of arrow 54 into the high pressure position shown in FIG. 3. Furthermore, the lower end of the injector piston 50 acts upon a fuel chamber 55. As the oil at the operational pressure urges the injector piston 50 from a low pressure position as shown in FIG. 2 to the high pressure position as shown in FIG. 3, the lower end of the piston 50 pressurizes the fuel in the fuel chamber 55.

The fuel chamber 55 is in fluid communication with a fill check valve 56 and an injection check valve 58. The fill check valve 56 prevents the flow of fuel from the fuel chamber 55 in the general direction of arrow 38. The injection check valve 58 prevents flow of fuel into the fuel chamber 55 in the general direction of arrow 54. As the injector piston 50 is moved to the high pressure position, the pressure of the fuel in the fuel chamber 55 increases and the high pressure fuel passes through the injection check valve 58 and fills a space 60. The high pressure fuel in space 60 urges the nozzle valve 62 in the general direction of arrow 54. A nozzle spring 64 is interposed between the housing 30 and the nozzle valve 62. The nozzle spring 64 biases the nozzle valve 62 in the general direction of arrow 53. When the force of the high pressure fuel in space 60 exceeds the bias force of the nozzle spring 64, the nozzle valve 62 is urged in the general direction of arrow 54 thereby placing the space 60 in fluid communication with the nozzle 66. Furthermore, the high pressure fuel is advanced from the space 60 to the nozzle 66 where the fuel is injected into the combustion chamber.

On a fill cycle, the engine control module 15 ceases to apply current to the solenoid 36, allowing the solenoid spring 41 to urge the injector valve 34 in the general direction of arrow 38 so as to isolate the injector oil inlet 26 from the injector oil chamber 32. Moreover, as the injector valve 34 moves in the general direction of arrow 38, the injector valve 34 unseats from the surfaces 46 and 48 thereby placing the injector oil chamber 32 in fluid communication with the injector oil outlet 28.

The bias force of the injector spring 52 then urges the injector piston 50 in the general direction of arrow 54 from the high pressure position to the low pressure position. Furthermore, as the injector spring 52 urges the injector piston 50 into the low pressure position, the injector piston 50 creates the residual pressure in the injector oil chamber 32. Oil at the residual oil pressure then exits the fuel injector 20 at the injector oil outlet 28 and is returned to the sump 19.

As the injector piston 50 moves in the general direction of arrow 54, the pressure in the fuel chamber 55 drops, thus allowing fuel to be drawn past the check valve 56 from the fuel supply port 68. The fuel in the fuel chamber 55 is then positioned for the subsequent injection cycle. Furthermore, as the pressure in the fuel chamber 55 drops, pressure in the space 60 drops. As pressure in the space 60 drops, the bias force of the nozzle spring 64 overcomes the force of the fuel in chamber 60 acting on the nozzle valve 62 thereby moving the nozzle valve 62 in the general direction of arrow 53. Thereafter, the nozzle valve 62 isolates the nozzle 66 from the chamber 60 thereby preventing fuel from being injected into the combustion chamber.

Figure 4:
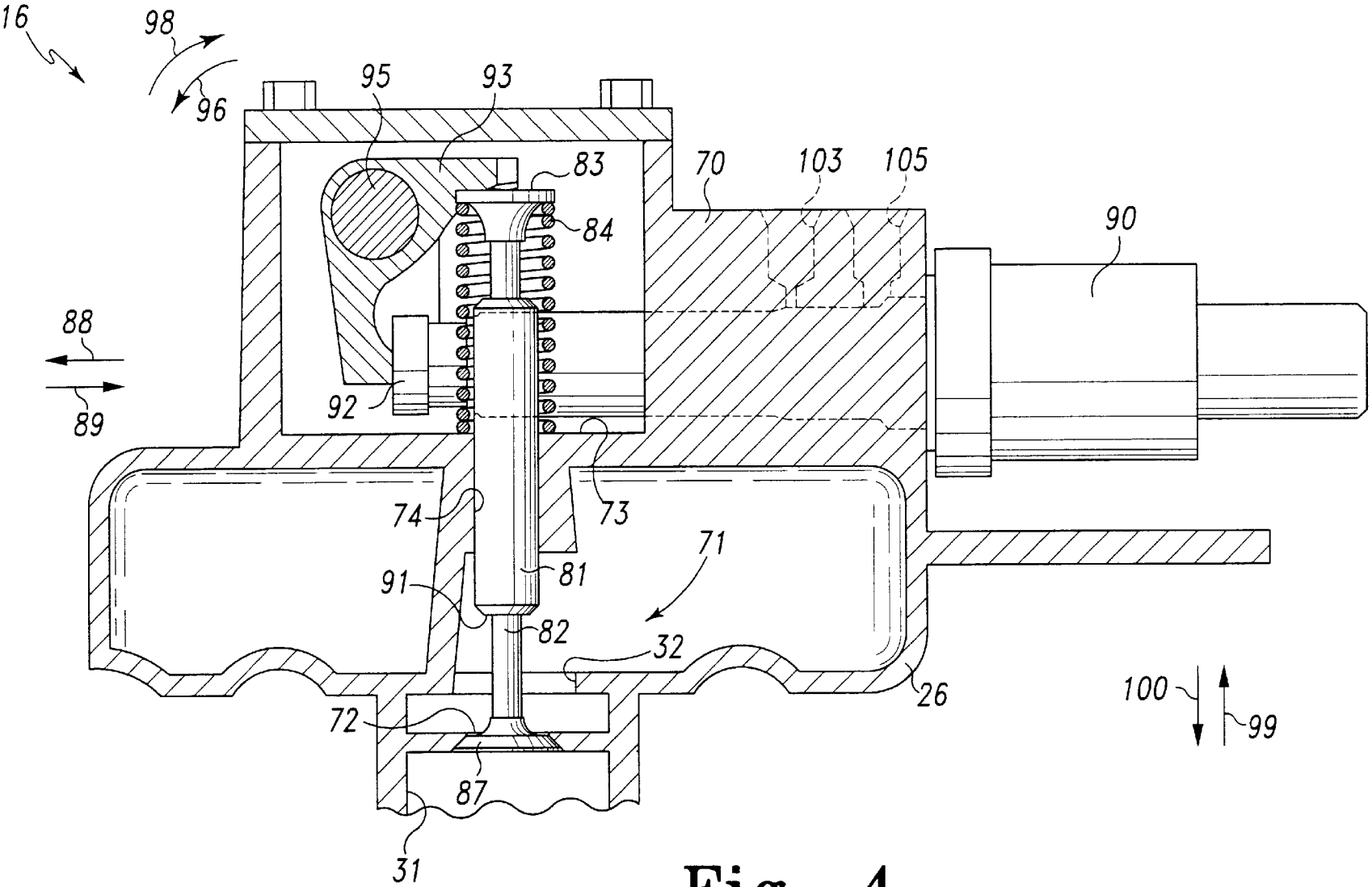
FIG. 4 is an enlarged cross sectional view of the valve assembly 16 of the internal combustion engine 10 of FIG. 1.

Referring now to FIG. 4, the valve assembly 16 further includes a valve housing 70 defining a valve chamber 71. The valve chamber 71 has an exhaust gas inlet or valve inlet 31 and an exhaust gas outlet or valve outlet 32 defined therein. The valve chamber 71 further has an opening 72 which places the valve inlet 31 in fluid communication with the valve outlet 32. As shown in FIG. 1, the exhaust manifold 14 is in fluid communication with the valve inlet 31 and the valve outlet 32 is in fluid communication with the intake manifold 12. The EGR valve assembly 16 selectively places the valve inlet 31 in fluid communication with the valve outlet 32 allowing exhaust gases to be advanced from the exhaust manifold 14 to the intake manifold 12.

The housing 70 further includes a valve opening 74 defined therein. The EGR valve assembly 16 further includes a valve sleeve 81, a valve member 82, a spring retainer 83, and a valve spring 84. The valve sleeve 81 is received through the valve opening 74 and is securely attached to the valve housing 70. The valve member 82 is received through a passage 91 defined in the valve sleeve 81. The valve member 82 is free to move in the general directions of arrows 99 and 100. The spring retainer 83 is secured to an upper end of the valve member 82. The valve spring 84 is interposed between the spring retainer 83 and a contact surface 73 of the housing 70. The spring 84 provides a bias force that urges the spring retainer 83, and thus the valve member 82, in the general direction of arrow 99.

The lower end of the valve member 82 includes a valve 87. As a result of the bias force of the spring 84, the valve member 82, and thus the valve 87 is urged in the general direction of arrow 99 thus causing the valve 87 to be seated in a first valve position. It should be appreciated that placing the valve 87 in the first position isolates the valve inlet 31 from the valve outlet 32.

The EGR valve assembly 16 further includes an actuator assembly 90, a rod 92, a pivot arm 93, and a pin 95. The actuator assembly 90 is nonmovably attached to the housing 70 as shown in FIG. 4. The rod 92 is operatively coupled to the actuator assembly 90 such that that the rod 92 can move in the directions of arrows 88 and 89. The pivot arm 93 is movably secured to the housing 70. In particular, the pivot arm 93 is secured to the housing 70 by the pin 95 such that the pivot arm 93 is free to move in the direction of arrows 96 and 98. An upper end of the pivot arm 93 is in contact with the upper surface of the valve member 82. Therefore, as the spring bias of the spring 84 urges the spring retainer 83 in the general direction of arrow 99, the pivot arm 93 rotates about the pin 95 in the general direction of arrow 96. As the pivot arm 93 rotates in the general direction of arrow 96, the lower end of the pivot arm 93 contacts the rod 92, urging the rod 92 in the general direction of arrow 89.

Upon receiving a control signal from an engine control module 15, the actuator assembly 90 advances the rod 92 in the general direction of arrow 88. As the force of the rod 92 overcomes the spring bias of the spring 84, the pivot arm 93 is urged in the general direction of the arrow 98. As the pivot arm 93 moves in the general direction of arrow 98, the upper end of the pivot arm 93 urges the valve member 82 in the general direction of arrow 100 thereby advancing the valve member 82 and the valve 87 in the general direction of arrow 100. It should be appreciated that the rod 92 urges the valve 87 downwardly into a second valve position. It should further be appreciated that positioning the valve 87 in the second position places the valve inlet 31 in fluid communication with the valve outlet 32.

Upon receiving a subsequent control signal from an engine control module 15, the actuator assembly 90 removes the force on the rod 92 allowing the bias force of the spring 84 to urge the rod 92 in the general direction of arrow 89. As the rod 92 moves in the general direction of arrow 89, the force of the rod 92 is removed from the lower surface of the pivot arm 93 thereby allowing the spring biases of the spring 84 to rotate the pivot arm 93 in the general direction of arrow 96. As the pivot arm 93 rotates in the general direction of arrow 96, the spring bias of the spring 84 urges the spring retainer 83, and thus the valve member 82 and the valve 87, in the general direction of arrow 99 thereby returning the valve 87 to the first valve position.

Referring now to FIGS. 5, 5A, 6, and 6A, there is shown the actuator assembly 90. The actuator assembly 90 includes an actuator housing 102 defining a chamber 104. The actuator assembly further includes an actuator oil inlet 103, an actuator oil outlet 105, and an intermediate chamber 107 each being in fluid communication with the chamber 104. The actuator oil inlet 103 is coupled to the pump outlet 24 and supplies the actuator assembly 90 operational pressure generated by the oil pump 18. The actuator oil outlet 105 is coupled to the oil sump 19 as shown in FIG. 1.

The actuator assembly 90 further includes a slider assembly 106 positioned in the chamber 104. The slider assembly 106 includes a spool 108 operatively coupled to a movement slug 110. The slider assembly 106 is movable in the direction of arrows 112 and 114.

Figure 5:
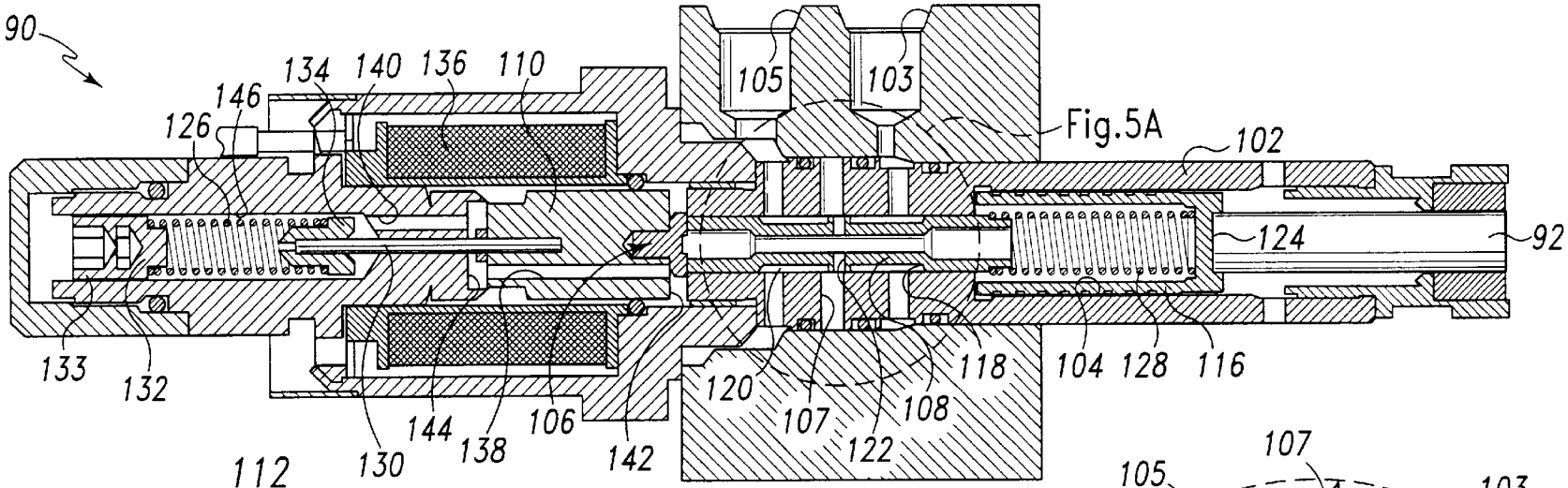
FIG. 5 is an enlarged cross sectional view of the actuator assembly of the valve assembly of FIG. 4 showing the actuator assembly in the deactuated position.
Figure 5A:
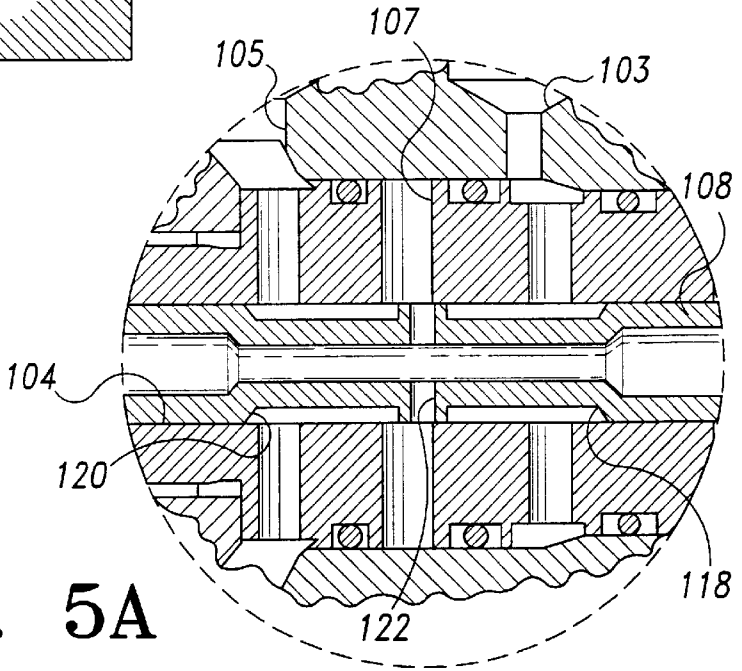
FIG. 5A is an enlarged view of a portion of FIG. 5 showing the spool of the actuator assembly.

The spool 108 includes a spool surface 118, a spool surface 120, and a spool passage 122. The spool passage 122 places the intermediate chamber 107 in fluid communication with the chamber 104. When the spool 108 is positioned in a first spool position, the spool surface 120 places the actuator oil outlet 105 in fluid communication with the intermediate chamber 107 thereby placing the actuator oil outlet 105 in fluid communication with the chamber 104 as shown in FIG. 5 and 5A. Moreover, when the spool 108 is positioned in the first spool position, the actuator oil inlet 103 is isolated from the intermediate chamber 107.

Figure 6:
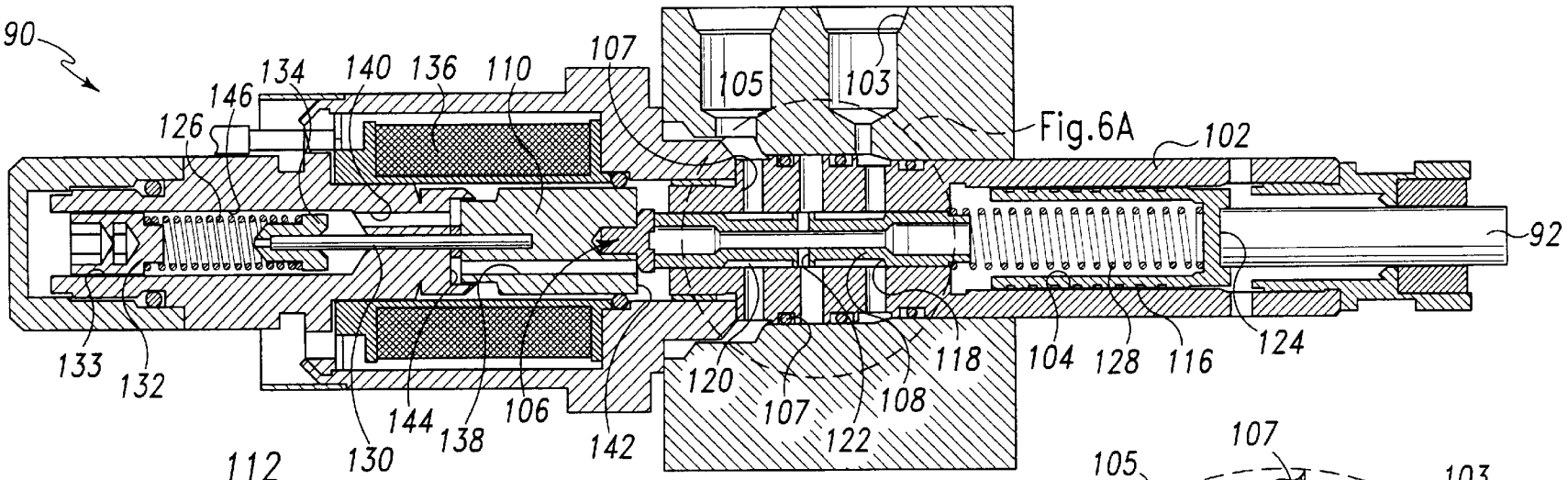
FIG. 6 is a view similar to FIG. 5 but showing the actuator assembly in the actuated position.
Figure 6A:
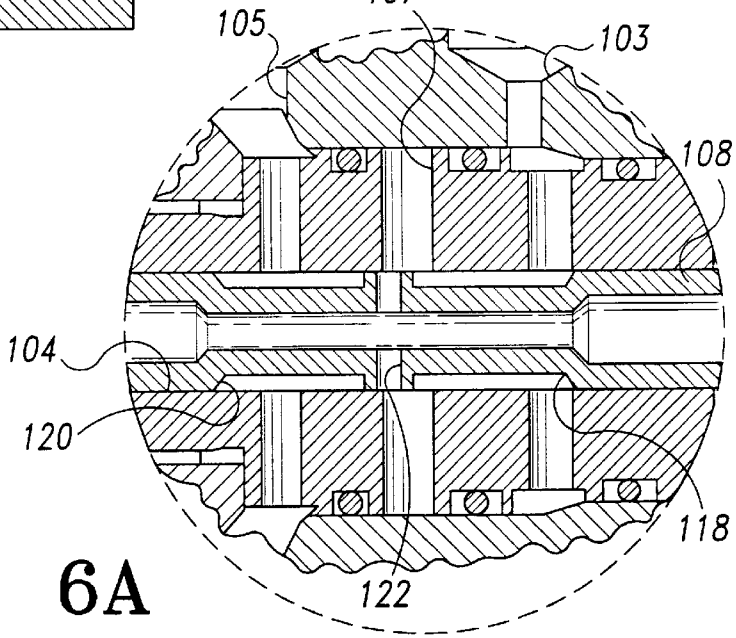
FIG. 6A is an enlarged view of a portion of FIG. 6 showing the spool of the actuator assembly.

Moving the spool 108 in the direction of arrow 114 positions the spool 108 into a second spool position as shown in FIGS. 6 and 6A. In the second spool position, the spool surface 118 places the actuator oil inlet 103 in fluid communication with the intermediate chamber 107 thereby placing the actuator oil inlet 103 in fluid communication with the chamber 104. Moreover, when the spool 108 is positioned in the second spool position, the actuator oil outlet 105 is isolated from the intermediate chamber 107. Thus, in the second spool position, pressurized oil is advanced into chamber 104 from the injector oil pump 18.

The actuator assembly 90 further has an actuator piston 116 positioned in the chamber 104. The actuator piston 116 is free to translate in the direction of arrows 112 and 114. As pressurized oil fills the chamber 104, the actuator piston 116 is urged in the general direction of arrow 112. An end 124 of the actuator piston 92 is operatively coupled the rod 92 such that the actuator piston 116 can urge the rod 92 in the general direction of arrow 112 so as to urge the rod 92 in the general direction of arrow 88 of FIG. 4. Similarly, the spring bias of spring 84 urges the actuator piston 116 in the general direction of arrow 114 when the rod 92 is urged in the general direction of arrow 89 (shown in FIG. 4). The actuator piston 116 is advantageously configured such that there exists adequate surplus operational pressure generated by the injector oil pump 18 at any engine operating condition which is great enough to produce a force on the actuator piston 116 capable of urging the rod 92 in the direction of arrow 112.

The actuator assembly 90 further includes a first spring 126, a slug rod 130, a set screw 132 and a spring retainer 134. The set screw 132 is inserted into a threaded portion 133 defined in the actuator housing 102. Clockwise rotation of the set screw 132 advances the set screw in the general direction of arrow 112 whereas counterclockwise rotation of the set screw 132 advances the set screw 132 in the general direction of arrow 114.

One end of the slug rod 130 is secured to the movement slug 110 such that that slug rod 130 is movable in unison with the movement slug 110 in the general direction of arrows 112 and 114. The spring retainer 134 is secured to a second end of the slug rod 130. The first actuator spring 126 is interposed between the set screw 132 and the spring retainer 134. It should be appreciated that the first spring 126 applies a biasing force to the movement slug 110 in the general direction of arrow 112. It should be further appreciated that the magnitude of the bias force applied to the movement slug 110 by the first spring 126 can be adjusted. In particular, advancing the set screw 132 in the general direction of arrow 112 compresses the first spring 126 thereby increasing the bias force of the first spring 126 on the movement slug 110 whereas advancing the set screw 132 in the general direction of arrow 114 decompresses the first spring 126 thereby decreasing the bias force of the first spring 126 on the movement slug 110.

The actuator assembly 90 further includes a second spring 128. The second spring 128 is interposed between the actuator piston 116 and the spool 108. In particular, the second spring 128 (1) biases the actuator piston 116 in the general direction of arrow 112, and (2) biases the spool 108 in the general direction of arrow 114. It should be further be appreciated that the magnitude of the bias force applied to the spool 108 and the actuator piston 116 by the second spring 128 varies. In particular, as the distance between the actuator piston 116 and the spool 108 increases, the second spring 128 decompresses thereby decreasing the bias force of the second spring 128 on the spool 108 and actuator piston 116. Whereas, as the distance between the actuator piston 116 and the spool 108 decreases the second spring 128 compresses thereby increasing the bias force of the second spring 128 on the spool 108 and actuator piston 116.

The actuator assembly 90 further includes a number of solenoid windings 136. When a current is applied to the solenoid windings 136, the solenoid windings 136 become excited and create a magnetic field which moves the movement slug 110 in the general direction of arrow 114. In particular, the movement slug 110 includes a magnetic alloy, such as iron or nickel, which is polarized in such a manner that the magnetic field applies a solenoid force to the movement slug 110 is in the general direction of arrow 114. Moreover, the magnitude of the magnetic field increases as the current applied to the solenoid windings 136 increases thereby applying a greater solenoid force to the movement slug 110 in the general direction of arrow 114.

It should be appreciated that only three forces act on the slider assembly 106. These three forces are as follows: (1) the bias force of the first spring 126 acting on the movement slug 110, (2) the bias force of the second spring 128 acting on the spool 108, and (3) the solenoid force acting on the movement slug 110. When no current is applied to the windings 136, the magnitude of the solenoid force is zero and the slider assembly 106 is positioned in the first slider position as shown in FIGS. 5 and 5A. It should further be appreciated that to maintain the slider assembly 106 in the first slider position while the solenoid force is zero, the bias force of the first spring 126 in the general direction of arrow 112 must be greater than the bias force of the second spring 128 in the general direction of arrow 114. Therefore, the set screw 132 must be advanced in the general direction of arrow 112, until the bias force of the first spring 126 exceeds the bias force of the second spring 128. Furthermore, it should be appreciated that when the slider assembly 106 is in the first slider position, the chamber 104 is in fluid communication with the actuator oil outlet 105. Thus, the pressure of oil in the chamber 104 is unable to urge the actuator piston in the general direction of arrow 112 and the actuator piston 116 is positioned in a first piston position shown in FIGS. 5 and 5A.

When a current is applied to the solenoid windings 136, the magnitude of the solenoid force urges the movement slug 110 in the general direction of arrow 114 thereby allowing the second spring 128 to urge the spool 108 in the general direction of arrow 114 into the second spool position. As the spool 108 is urged into the second spool position the actuator oil inlet 103 is placed into fluid communication with the chamber 104. As pressurized oil fills the chamber 104 it advances to a chamber 142. From the chamber 142, the oil advances to a chamber 144 via the passage 138 defined in the movement slug 110. From the chamber 144, the oil advances to a chamber 146 via a passage 140 defined in the actuator housing 102. The chambers 104, 142, 144, and 146 are advantageously configured such the net force due to oil pressure on the slider assembly 106 in the general direction of arrows 112 or 114 is always zero. Thus, pressurized oil acting on the slider assembly 106 does not move the slider assembly 106.

However, as pressurized oil fills the chamber 104, the actuator piston 116 is urged in the general direction of arrow 112 into a second piston position as shown in FIGS. 6 and 6A. Pressurized oil will continue to move the actuator piston 116 in the general direction of arrow 112 until the spool 108 is returned to the first spool position. In particular, as the actuator piston 116 moves in the general direction of arrow 112, the second spring 128 decompresses thereby decreasing the force of the second spring 128 on the slider assembly 106. The actuator piston 116 will continue to advance in the general direction of arrow 112 until the force of the first spring 126 acting on the movement slug 110 in the general direction of arrow 112 is greater than solenoid force added to the reduced force of the second spring 128 acting in the general direction of arrow 114.

When force of the first spring 126 acting on the movement slug 110 is greater than solenoid force added to the reduced force of the second spring 128, the slider assembly 106 will be urged in the general direction of arrow 112 into to the first slider position. Thus, the chamber 104 will be isolated from the actuator oil inlet 103 and the spring bias force of spring 84 will urge the rod 92 and the actuator piston 116 in the general direction of arrow 114. As the actuator piston 116 moves in the general direction of arrow 114, the force in the second spring 128 will increase thereby moving the slider assembly 106 to the second slider position. Thus, an equilibrium state is reached wherein if the actuator piston 116 is advanced in the general direction of arrow 112 the slider assembly 106 will move to the first slider position and isolate the actuator oil inlet 103 from the chamber 104 thereby allowing the rod 92 to urge the actuator piston 116 in the general direction of arrow 114. Conversely, if the actuator piston 116 advances in the general direction of arrow 114 the slider assembly 106 will be moved to the second slider position and pressurized oil will be placed in fluid communication with the chamber 104 thereby moving the actuator piston 116 in the general direction of arrow 112. It should be appreciated that the position of the actuator piston 116 at which the equilibrium is established is proportional to the solenoid force since the distance that the second spring 128 decompresses is proportional to the force required to place the slider assembly 106 in equilibrium. In particular, increasing the solenoid force moves the actuator piston 116 a greater distance in the general direction of arrow 112, and decreasing the solenoid force moves the actuator piston 116 a smaller distance in the general direction of arrow 114 relative to the distances shown in FIGS. 5, 5A, 6, and 6A.

INDUSTRIAL APPLICABILITY

In operation, the fuel injector 20 injects a quantity of fuel into the combustion chamber (not shown) of the internal combustion engine 10. The operational pressure from the injector oil pump 18 is used to pressurize the fuel before it is injected into the combustion chamber. The operational pressure from the injector oil pump 18 is also supplied to the actuator oil inlet 103. After the oil pressurizes the fuel, the oil exits the fuel injector 20 at the injector oil outlet.

Under certain engine operating conditions, it is desirable to prevent the formation of $NO_x$. Therefore, exhaust gases must be advanced from the exhaust manifold 14 to the intake manifold 12. During such operating conditions, the engine control module 15 of the internal combustion engine 10 generates a current which is sent to the actuator assembly 90 shown in FIGS. 5 and 6.

The current is applied to the solenoid windings 136 of the actuator assembly 90 so as to create a magnetic field. The magnetic field urges the movement slug 110 of the slider assembly 106 in the general direction of arrow 114 thereby moving the slider assembly 106 into the second slider position so as to place the injector oil inlet 103 in fluid communication with the chamber 104. As pressurized oil enters the chamber 104, the actuator piston 116 is urged in the general direction of arrow 112 thereby reducing the bias force of the second spring 128 as shown in FIGS. 6 and 6A. The actuator piston 116 continues to advance in the direction of arrow 112 until the bias force of the first spring 126 overcomes the solenoid force and the reduced bias force of the second spring 128. Thereafter, the slider assembly 106 returns to the first slider position thus causing the actuator oil inlet 103 to be isolated from the chamber 104. An equilibrium is established whereby the actuator piston 116 is maintained in a position that corresponds to a particular current applied to the windings 136.

As the actuator piston 116 advances in the general direction of arrow 112, the actuator piston 116 urges the rod 92 in the general direction of arrow 88 as shown in FIG. 4. As the rod 92 moves in the general direction of arrow 88, the rod 92 causes the pivot arm 93 to rotate in the general direction of arrow 98. As the pivot arm 93 rotates, the upper surface of the pivot arm 93 urges the valve member 82 and thus the spring retainer 83 and valve 87 in the general direction of arrow 100 thereby moving the valve assembly 16 from the first valve position to the second valve position. In the second valve position, the valve inlet 31 is placed in fluid communication with the valve outlet 32 thereby allowing exhaust gases to advance from the exhaust manifold 14 via the valve inlet 31 to the intake manifold 12 via the valve outlet 32.

Subsequently, the engine control module 15 of the internal combustion engine 10 ceases to generate a current. Without a current applied to the solenoid windings 136 no solenoid force is applied to the slider assembly 106, and the first spring 126 returns the slider assembly 106 to the first slider position thereby isolating the chamber 104 from the actuator oil inlet 103. The bias force of the spring 84 applied to the rod 92 then urges the actuator piston 116 into the first piston position.

As the actuator piston 116 and rod 92 advance in the general direction of arrow 114, the rod 92 moves in the general direction of arrow 89 in FIG. 4. As the rod 92 moves in the general direction of arrow 89, the pivot arm 93 rotates in the general direction of arrow 96. As the pivot arm 93 rotates, the spring 84 moves the valve member 82 and the valve 87 in the general direction of arrow 99 so as to move the valve assembly 16 from the second valve position to first valve position. In the first valve position, the valve inlet 31 is isolated from fluid communication with the valve outlet 32 thereby preventing exhaust gases from advancing from the exhaust manifold 14 via the valve inlet 31 to the intake manifold 12 via the valve outlet 32.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, although the internal combustion engine 10 is herein described as being configured with the fuel injector 20 and the EGR valve assembly 16 both coupled to the pump outlet 24 of the injector oil pump 18 and has significant advantages thereby in the present invention, the EGR valve assembly 16 could be coupled to the injector oil outlet 28 of the fuel injector 20. In such a configuration, the residual pressure at the injector oil outlet 28 is used to power the EGR valve assembly 16.

What is claimed is:

1. An engine assembly which includes (1) an injector oil pump having a pump outlet, said injector oil pump generating an operational pressure at said pump outlet, (2) a fuel injector having an injector oil inlet, and an injector piston, wherein (i) said injector oil inlet is in fluid communication with said pump outlet of said injector oil pump, (ii) operational pressure at said injector oil inlet acts on said injector piston so as to move said injector piston from (A) a low pressure position in which fuel is prevented from being advanced out of said fuel injector, to (B) a high pressure position in which fuel is advanced out of said fuel injector, and (3) an actuator assembly, said actuator assembly comprising:

an actuator housing defining a chamber and an actuator oil inlet, said actuator oil inlet being in fluid communication with said pump outlet, a slider located within said chamber, said slider being positionable between a first slider position and a second slider position, wherein (1) said slider isolates said actuator oil inlet from said chamber when said slider is located in said first slider position, and (2) said actuator oil inlet is in fluid communication with said chamber when said slider is located in said second slider position;

a movement assembly for moving said slider between a first slider position and a second slider position;

an actuator piston located within said chamber, said actuator piston being movable between a first piston position and a second piston position; and wherein said operational oil pressure moves said actuator piston from said first piston position to said second piston position when said slider is located in said second slider position.

2. The engine assembly of claim 1, wherein:

said movement assembly comprises (i) a first spring which applies a first biasing force against said slider in a first direction, and (ii) a second spring which (A) applies a second biasing force against said slider in a second direction, and (B) applies a third biasing force against said actuator piston in said first direction.

3. The engine assembly of claim 2, wherein:

said movement assembly further includes a solenoid winding, said slider includes a movement slug and a spool, said solenoid winding and said actuator slug forms a solenoid, and said solenoid biases said slider in said second direction.

4. The engine assembly of claim 3, wherein:

applying a first current to said actuator winding causes said actuator piston to be displaced a first distance within said chamber, applying a second current to said actuator winding causes said actuator piston to be displaced a second distance within said chamber, and said first current is different from said second current.

5. The engine assembly of claim 4, wherein said actuator assembly further comprises:

a piston rod which is movable between a first rod position and a second rod position, wherein (1) said piston rod is positioned in said first rod position when said actuator piston is located in said first piston position, and (2) said piston rod is positioned in said second rod position when said actuator piston is located in said second piston position.

6. The engine assembly of claim 5, wherein said actuator assembly further comprises a third spring which biases said piston rod toward said first rod position.

7. The engine assembly of claim 2, wherein:

said actuator assembly further comprises a set screw which is threadingly engaged within a screw hole defined in said actuator housing, and rotation of said set screw urges said first spring in said first direction.

8. The engine assembly of claim 1, further including an oil sump wherein:

said actuator assembly further includes an oil outlet which is in fluid communication with said chamber and said oil sump, and said fuel injector further has an injector oil outlet which is in fluid communication with said oil sump.

9. An method of actuating a valve in an engine assembly which includes (1) an injector oil pump having a pump outlet, the injector oil pump generating an operational pressure at the pump outlet, (2) a fuel injector having an injector oil inlet, and an injector piston, wherein (i) the injector oil inlet is in fluid communication with the pump outlet of the injector oil pump, and (ii) operational pressure at the injector oil inlet acts on the piston so as to move the injector piston from (A) a low pressure position in which fuel is prevented from being advanced out of the fuel injector, to (B) a high pressure position in which fuel is advanced out of the fuel injector, (3) an actuator assembly, the actuator assembly having (i) an actuator housing defining a chamber, (ii) an actuator oil inlet being in fluid communication with the pump outlet, (iii) a slider located within the chamber, the slider being positionable between a first slider position and a second slider position, and (iv) an actuator piston located within the chamber, the actuator piston being movable between a first piston position and a second piston position, and (4) a movement assembly for moving a slider between a first slider position and a second slider position, comprising the steps of:

isolating the actuator oil inlet from the chamber when the slider is located in the first slider position, placing the actuator oil inlet is in fluid communication with the chamber when the slider is located in the second slider position, and moving the actuator piston with the operational pressure from the first piston position to the second piston position when the slider is located in the second slider position.

10. The method of claim 9, wherein the movement assembly comprises a first spring, a second spring and a movement slug, further comprising the steps of:

biasing the slider in a first direction with the first spring;

biasing the slider in a second direction with the second spring;

biasing the actuator piston in the first direction with the second spring.

11. The engine assembly of claim 9, wherein (i) the movement assembly further includes a solenoid winding, (ii) the slider includes a movement slug and a spool, (iii) the solenoid winding and the movement slug forms a solenoid, and (iv) the solenoid biases the slider in a second direction, further comprising the steps of:

applying a first current to the actuator winding so as to cause the actuator piston to be displaced a first distance within the chamber; and applying a second current to the actuator winding so as to cause the actuator piston to be displaced a second distance within the chamber, wherein the first current is different from the second current.

12. The method of claim 9, wherein the actuator assembly further comprises a piston rod which is movable between a first rod position and a second rod position, further comprising the steps of:

positioning the piston rod in the first rod position when the actuator piston is located in the first piston position, and positioning the piston rod in the second rod position when the actuator piston is located in the second piston position.

13. The method of claim 9, further the comprising the step of:

biasing the piston rod toward the first rod position with a valve spring.

14. The method of claim 9, wherein the actuator assembly further comprises a set screw which is threadingly engaged within a screw hole defined in the actuator housing, further comprising the steps of:

rotating the set screw; and urging the first spring in the first direction in response to the rotating step.

* * * * *

UNITED STATES PATENT AND TRADEMARK OFFICE

CERTIFICATE OF CORRECTION

PATENT NO. : 5,865,156

DATED : February 2, 1999

INVENTOR(S) : Dennis D. Feucht, et al.

It is certified that error appears in the above-identified patent and that said Letters Patent is hereby corrected as shown below:

Title page, item [75] Inventors:

Please correct the spelling of one of the inventor's names to read:
Mylvaganam Arulraja Signed and Sealed this Eleventh Day of April, 2000

*Attest:*

*Attesting Officer*

Q. TODD DICKINSON

*Director of Patents and Trademarks*